US005119756A

United States Patent [19]

Norton

[11] Patent Number: 5,119,756

[45] Date of Patent: Jun. 9, 1992

[54] APPARATUS FOR THE MIXING OF PARTICULATE MATERIALS

[76] Inventor: R. Scott Norton, Box 23, Rocanville, Saskatchewan, Canada, S0A 3L0

[21] Appl. No.: 535,561

[22] Filed: Jun. 11, 1990

[30] Foreign Application Priority Data

Jun. 27, 1989 [CA] Canada ..... 604085

[51] Int. Cl.[5] ..... B05B 15/06

[52] U.S. Cl. ..... 118/407; 118/417

[58] Field of Search ..... 366/177, 181, 318, 319, 366/320, 76; 118/407, 417

[56] References Cited

U.S. PATENT DOCUMENTS

| | | | |
|---|---|---|---|
| 900,837 | 10/1908 | Dougan | 366/181 |
| 3,263,592 | 8/1966 | Hickey et al. | 118/303 |
| 3,291,458 | 12/1966 | Hamm | 118/303 |
| 3,291,883 | 12/1966 | Cornelius et al. | 366/318 |
| 4,079,696 | 3/1978 | Weber | 118/417 |
| 4,194,842 | 3/1980 | Puthawala | 366/318 |
| 4,211,121 | 7/1980 | Brown | 366/116 |
| 4,344,710 | 8/1982 | Johnson et al. | 366/76 |
| 4,465,017 | 8/1984 | Simmons | 118/418 |
| 4,503,803 | 3/1985 | Barnes | 118/303 |
| 4,561,781 | 12/1985 | Seymour | 366/381 |
| 4,586,459 | 5/1986 | Schultz | 118/303 |
| 4,900,155 | 2/1990 | Schwarz et al. | 366/76 |

*Primary Examiner*—Jay H. Woo
*Assistant Examiner*—J. F. Durkin
*Attorney, Agent, or Firm*—Adrian D. Battison; Stanley G. Ade; Murray E. Thrift

[57] ABSTRACT

A unit for mixing a powder onto a particulate material for example an inoculant onto seeds includes a device which can be clamped around an auger tube and includes a liquid dispenser and a power dispenser. The liquid dispenser communicates with an inlet into the auger tube spaced downwardly of the unit. A powder hopper includes an opening for dispensing through a tube into the auger tube with the powder hopper being vibrated to feed the powder into the auger tube. The liquid acts as an adhesive agent coating the seeds so that the powder inoculant can be adhered to the seeds at a position downstream of the injection of the liquid at a point where the liquid is fully mixed.

16 Claims, 3 Drawing Sheets

APPARATUS FOR THE MIXING OF PARTICULATE MATERIALS

BACKGROUND OF THE INVENTION

This invention relates to an apparatus and method for mixing of particulate materials which is particularly but not exclusively designed for use in applying an inoculating material onto seeds.

The application of an inoculating materials onto seeds prior to planting is becoming more widespread. At the present time little or no commercial equipment is available for the necessary mixing process and this is often therefore done by hand. The process firstly requires that an adhesive or sticking agent is applied to the seeds and thoroughly mixed with the seeds so that each seed has a layer of the sticking agent at least partly covering the seed. Subsequently it is necessary to apply the particulate inoculate material generally in powder form which then attaches to the adhesive agent on the seeds to ensure that the seed carries a sufficient quantity of the inoculate material. This mixing is of course very difficult by hand in the quantities required and requires vigorous physical effort and also presents the worker with a problem of being accessable to the various chemical materials which is highly undesirable.

One example of a device for coating seeds is shown in U.S. Pat. No. 4,465,017 (Simmons) which comprises a free standing machine having a first chamber for injecting the liquid adhesive agent and a second chamber into which the material falls from the first chamber for mixing the powder or particulate coating material. This device has achieved little success and is relatively expensive as it is a free standing unit. Furthermore it requires separate handling of the seeds so that they are fed into the machine at one end and then removed from the discharge at the other end.

SUMMARY OF THE INVENTION

It is the object of this invention to provide an improved device for mixing particulate materials.

According to the first aspect of the invention a method of applying a coating material onto the individual particles of a particulate material comprising transporting the particulate material along an auger from a feed end to a discharge end of the auger by rotating a flight of the auger to feed the material along a tube of the auger, feeding into the auger tube at a first position thereon a liquid adhesive agent for mixing with the particulate material as it moves along the tube, and at a second position spaced downstream of the first position and upstream of the discharge end feeding into the auger tube the coating material for mixing with the particulate material, the spacing of the second position from the first position and from the discharge end being arranged such that the adhesive agent is spread over the particulate material by the action of the auger upstream of the second position and such that the coating material is mixed with the particulate material between the second position and the discharge end.

According to the second aspect of the invention that is provided an apparatus for mixing a first particulate material with a second particulate material comprising an auger having an auger tube with a feed end and a discharge end and an auger flight for rotation within the tube so as to feed material from the feed end to the discharge end, a first feed means having a liquid tank and means for feeding liquid from the tank into the auger tube at a first position thereon for mixing with the particulate material as it moves along the tube, and a second feeding means having a hopper for said first particulate material, and means for feeding said first particulate material from the hopper into the auger tube at a second position for mixing with the second particulate material within the auger tube.

According to the third aspect of the invention that is provided an apparatus for mixing a first particulate material with a second particulate material comprising an auger having an auger tube with a feed end and a discharge end and an auger flight for rotation within the tube so as to feed material from the feed end to the discharge end, feeding means having a hopper for said first particulate material, and means for feeding said first particulate material from the hopper into the auger tube at a position thereon for mixing with the second particulate material within the auger tube, wherein the hopper includes a downwardly inclined bottom surface, an opening adjacent at the lowermost edge of the bottom surface through which the material is discharged from the hopper, gate means for varying the size of the opening, and means for vibrating the hopper to cause the material to escape from the hopper through the opening.

With the foregoing in view, and other advantages as will become apparent to those skilled in the art to which this invention relates as this specification proceeds, the invention is herein described by reference to the accompanying drawings forming a part hereof, which includes a description of the best mode known to the application and of the preferred typical embodiment of the principles of the present invention, in which:

DETAILED DESCRIPTION

Figure 1:
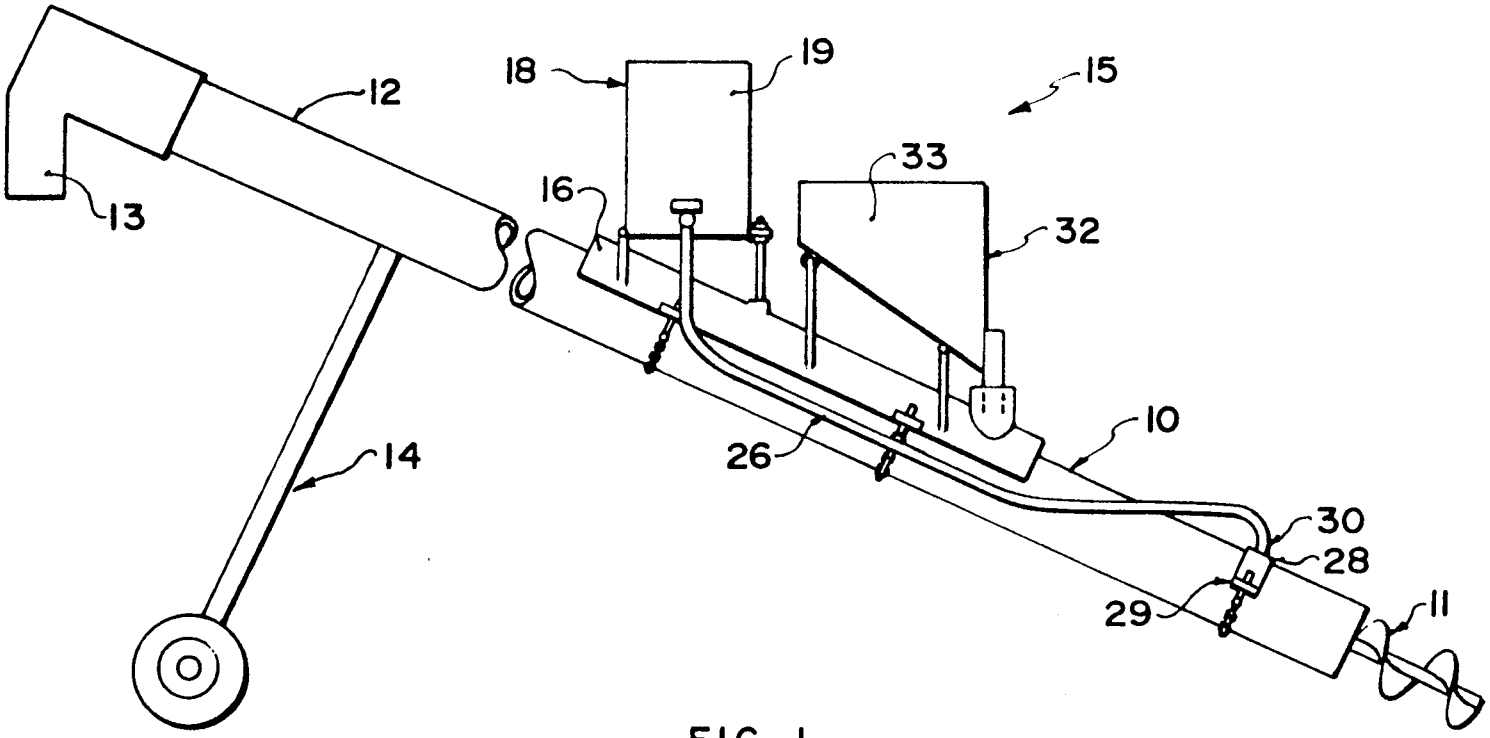
FIG. 1 is a side elevational view of an auger incorporating an attachment device for mixing a particulate material with the material within the auger.

The operators as shown in FIG. 1 comprises an auger generally indicated at 10 including an auger flight 11, an auger tube 12 and a discharge spout 13. A portion of the flight is exposed at the lower end of the auger tube to grasp the particulate material to be fed particularly grain nor seeds for transportation through the tube and discharged through the spout 13 into suitable collecting container (not shown). The auger tube is supported upon a wheel and strut assembly 14 which is shown schematically since this is well known to one skilled in the art.

Figure 2:
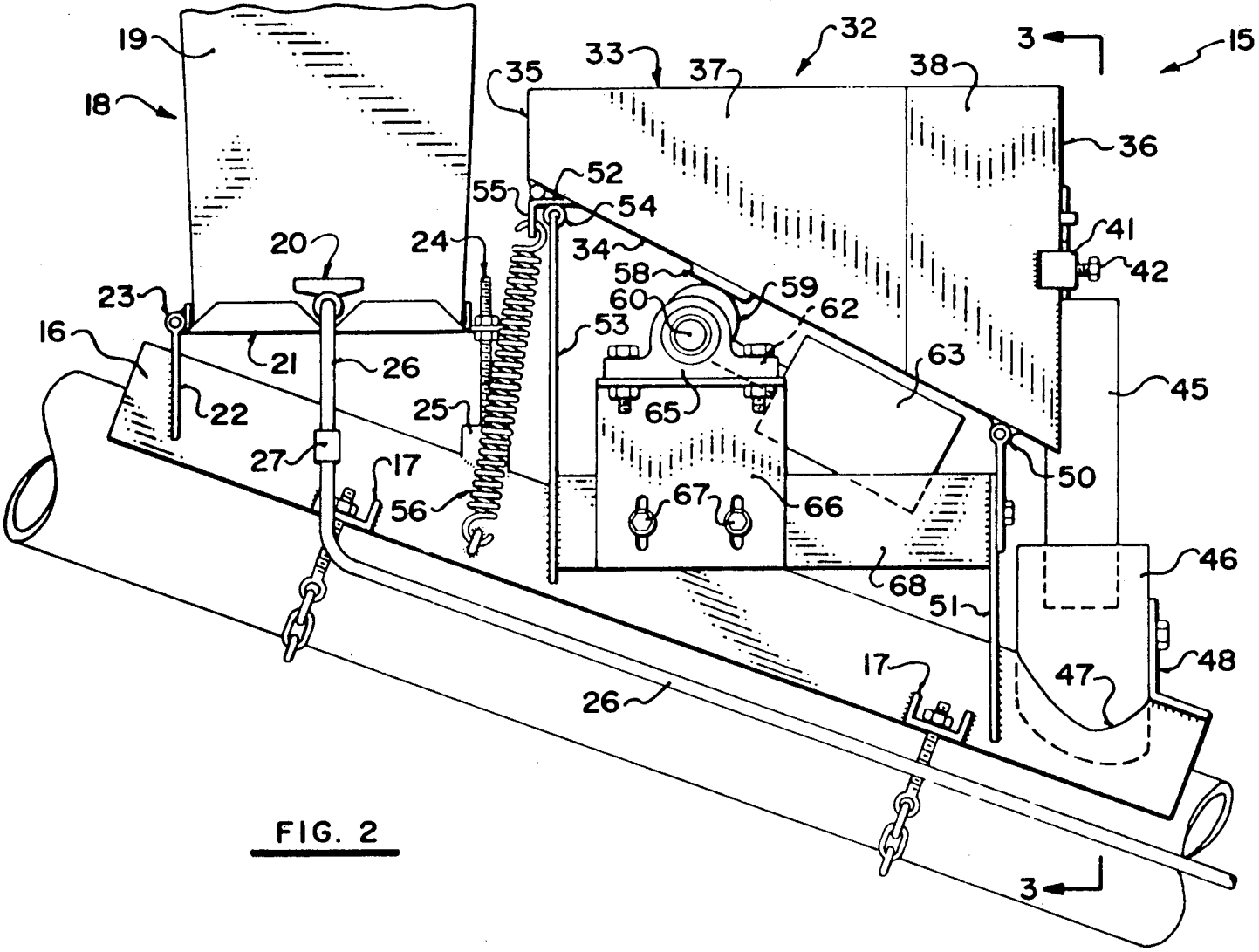
FIG. 2 is a side elevational view of the attachment portion of FIG. 1 on a larger scale.
Figure 3:
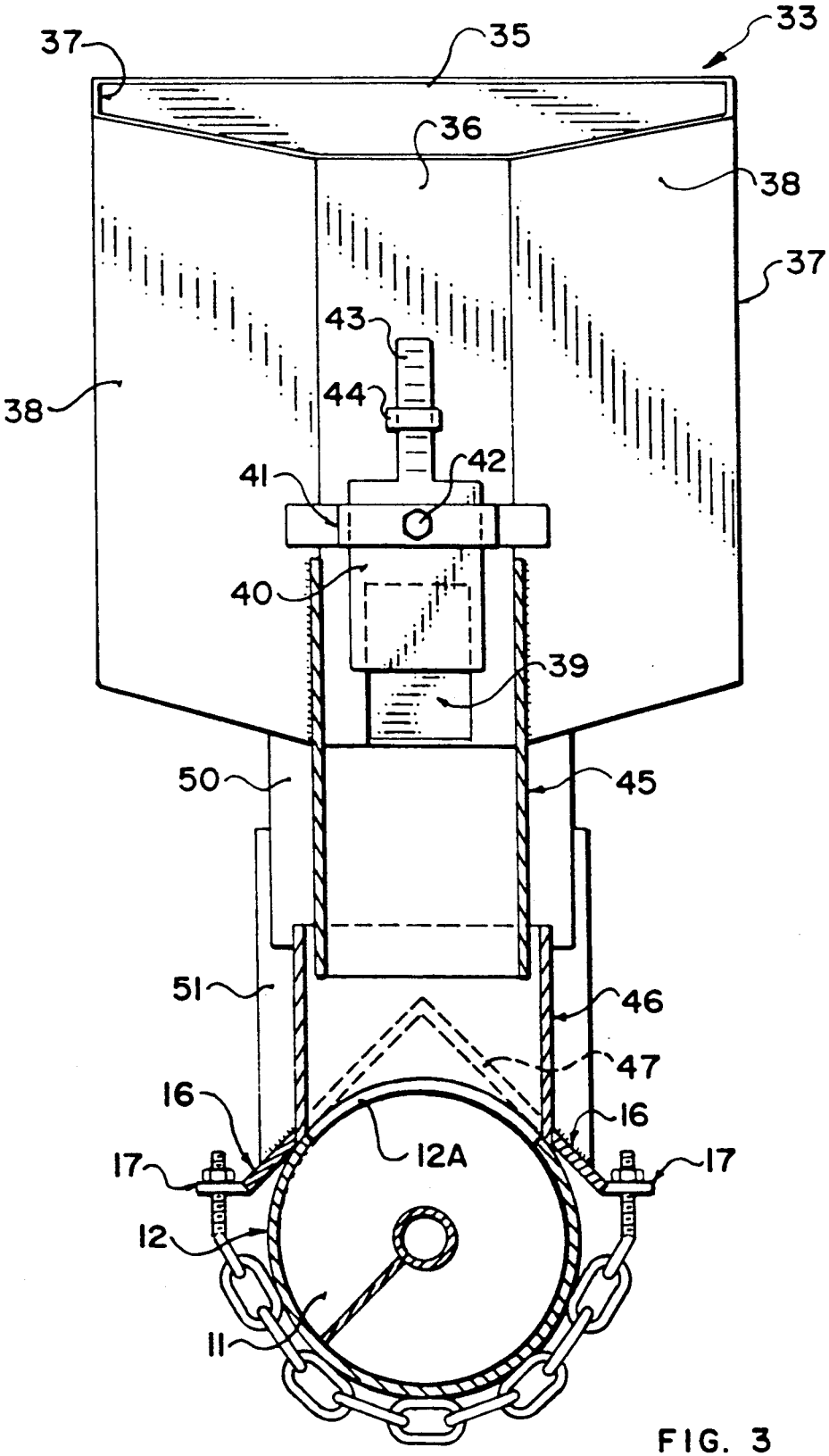
FIG. 3 is a cross sectional view along the line 3—3 of FIG. 2.

The auger described above is of course entirely conventional but is modified by the application thereto of a mixing attachment generally indicated at 15 which is shown in most detail in FIGS. 2 and 3.

The attachment 15 comprises a support member 16 in the form of an angle iron which is arranged with the apex upward and parallel to the axis of the auger tube. The angle iron can thus be strapped down onto the upper surface of the auger tube by way of two pairs of flanges 17 with the pair being spaced adjacent respective ends of the angle iron 16 with one of each pair being on either side of the angle iron as best shown in FIG. 3. A chain connection extends around the underside of the auger tube so as to strap the angle iron downwardly onto the auger tube in fixed position. In this way the attachment can be simply applied and removed without difficulty so the auger can be reverted to conventional use as required.

At an upper end of the support member 16 is provided a first container generally indicated at 18 in the form of a liquid tank 19 with a dispensing nozzle 20. The liquid tank is mounted upon a base frame 21 carried on the support member 16. The base frame is attached to the support member by a plate 22 which is connected to one end of the base 21 by hinge 23 allowing some pivotal action. The plate 22 is a flat plate with a V-shaped cut out at its lower edge so that is can extend over the upper surface of the angle iron for welding thereto as shown. The other end of the base 21 is connected to the support 16 by way of a screw 24 which is supported on a welded stud 25 carried on the upper surface of the support 16. The base 21 has a flange which is clamped between a pair of nuts carried on the screw 24 so that the height of the flange and thus the base 21 can be adjusted by rotating the nuts on the screw. In this way the base 21 can be maintained in a horizontal or level condition regardless of variations in the angle of the auger tube to accommodate different heights of discharge. The container 19 is preferably a plastic container which is strapped into place on the base 21 and has a suitable opening at the upper surface for receiving a liquid for discharge through the spout 20.

A hose line 26 is connected to the spout 20 for receiving the liquid discharged. The hose has a metering valve 27 positioned adjacent its inlet end and extends from the metering valve down the auger tube as shown in FIG. 1 to a position below the support 16. At the lower end of the tube is mounted an inlet bracket 28 which comprises a part cylindrical portion which wraps around the upper part of the auger tube and a pair of flanges 29 similar to the flanges 17 so that the half cylindrical portion can be strapped onto the tube at a first position there on. Within the tube is provided an opening which is preferably the order of one inch in diameter so that liquid discharge from a half inch diameter tube 26 can enter through a right angle injection nozzle at the connection between the pipe 26 and the bracket 28 as indicated at 30. Liquid from the tank 19 thus runs under gravity from the tank into the auger tube at the bracket 28 at a rate controlled by the metering valve 27.

Below the first container 18 on the support member 16 is mounted a second container system generally indicated at 32. The second container comprises a hopper 33. The hopper has an inclined lower wall 34 which inclines downwardly from a rear vertical wall 35 to a front vertical wall 36. The sides of the hopper comprise first portions 37 parallel to each other and at right angles to the rear wall 35 and inwardly inclined portions 38 so the material as it runs down the lower wall 34 is converged by the inwardly inclined lower portions 38 toward the narrower front wall 36. The front wall 36 has an opening 39 at the bottom of the front wall so that material can be discharged through the opening. The opening is controlled by a slideable gate 40 which can be moved up and down to open and close the opening by sliding action through a channel member 41 and can be locked in placed by a screw 42 which extends through the channel member. A gauge is indicated at 43 and is connected to the gate for sliding action through a loop 44 which acts as guide and also as a marker for the gauge 43. The opening 39 discharges into a tubular duct 45 which depends downwardly from the front face 36.

A tubular duct 46 of larger diameter is connected to the upper surface of the support member 16 and projects through an opening 47 formed in the support member 16. An upwardly extending flange 48 is connected to the tubular duct 46 for vertical adjustment of the height of the tubular duct 46 so that its lower end is adjustable relative to the outer surface of the auger tube 12. The tubular duct 45 thus deposits into the larger tubular duct 46 to guide the particulate material that exits from the container so that it is properly guided to drop into a circular opening 12A formed in the upper surface of the auger tube 12.

The lower or front end of the hopper 33 is supported by a hinged connection 50 mounted upon a vertical plate 51 welded on the upper surface of the support member 16. The rear end of the hopper 33 is supported upon a flange 52 which extends in a horizontal plane across the rear edge of the lower wall 34. The underside of the flange 52 rests upon a vertical plate 53 and more particularly upon a rubber or resilient bead 54 carried on the upper edge of the plate 53. The plate 53 is welded to the upper surface of the support 16 so as to extend vertically upwardly therefrom. A rear edge of the flange 52 carries a loop 55 which connects to a spring 56 the other end of which is connected to a further loop 57 welded on the side of the support 16. Thus the rear end of the hopper can move upwardly and downwardly and is resiliently restrained at a lower position by its co-operation with the bead 54 and the spring 56. It is however free to pivot about the hinge 50.

A striker plate 58 is provided on the under surface of the lower wall 34. The striker plate 58 is struck by a cam 59 mounted upon a shaft 60 rotatable about an axis transverse to the lower wall 34. Thus the cam 59 repeatedly engages the striker plate 58 to lift the striker plate 58 and thus the hopper through a small distance to cause a vibration within the hopper for each rotation of the shaft 60. The shaft is driven through a right angle gear reduction system (not shown) which is in turn driven by a shaft 62 and an electric motor 63. The motor 63 is of the 12 volt variety so that it can be driven by the electrical system of the auger itself or of a co-operating tractor unit. The shaft 60 is carried in pillow blocks 65 mounted upon a plate 66 which is adjustable vertically by way of screws 67. The screws 67 co-operate with a transverse plate 68 carried on the vertical plates 51 and 53.

Alternative arrangements can be used for metering the material through the gate from the hopper. In one other example (not shown) a rotating eccentric is mounted directly on the hopper so as to generate vibration without the striking effect, thus reducing noise. Metering by roller feed can also be used.

In operation an adhesive agent in liquid form is filled into the container 19. A treatment material in particulate or powder form is applied into the hopper 33. The valve 20 is then operated to commence the flow of the liquid from the container through the pipe 26 to discharge into the auger tube at a first position adjacent the feed end.

The auger flight is started so the particulate material particularly seeds is collected from the feed end and carried along the auger tube with discharge through the spout of the upper end. As the seeds pass the first position, the liquid enters the seeds and is mixed with the seeds by way of the rotation of the flight as it carries the seeds upwardly toward the second position which is at the opening 12A where the hopper 33 discharges into the auger tube. At the second position the adhesive agent is already well mixed with the seeds so the powder when applied into the auger tube onto the seeds mixes with the seeds and adheres to the adhesive agent. The spacing between the first position where the liquid is applied and the second position where the powder is applied is arranged to be sufficient (approximately 5 feet has been found sufficient in practice) to enable full mixing of the liquid with the seeds. The unit containing the liquid and the powder hopper is positioned thus approximately 5 or 6 feet from the lower end of the auger which is a convenient position for manual operation of the various parts.

The feed of the powder material from the hopper is carried out by accuating the motor 63 which drives the vibration action of the hopper thus causing the material to be discharged in doses from the hopper through the opening and into the auger tube. The speed of the feed system can be varied by increasing or decreasing the size of the opening by adjusting the gate 40 or can be varied by varying the vibration effect of the hopper. The use of a direct drive motor enables simple adjustment of the speed of the motor to vary the vibration effect.

The device proposed has particular use for the inoculation of seeds in which the seeds are transported by the auger and the inoculate powder is applied from the hopper 33.

However other uses of this device are possible as follows:

(a) blending grass seed;

(b) blending granular chemicals with oil seeds;

(c) blending mustard or canola with peas;

(d) blending different kinds of cereal grain; and (e) treating all types and varieties of grain.

In some of these cases the liquid is not needed so that the valve on the liquid container simply closed off and only the feed system from the hopper 33 is used to obtain the mixing effect.

The unit can be readily removed from the auger by unstrapping the support 16 and the liquid dispensing bracket. The exposed holes in the tube can then be covered by a suitable temporary patching technique.

In an alternative arrangement of the device (not shown) a number of modifications are made as follows:

(a) in place of the simple gravity feed from the liquid supply tank there is provided a pump driven from the same battery source as the motor for the vibration of the tank, a valve for controlling accurately the flow rate from the pump, a flow meter for accurately measuring the flow so that the flow can be more accurately controlled through the pump through the discharge nozzle and a return valve so that the liquid can be immediately shut off and returned from the pump to the container. The various items are propriety equipment readily available from various sources depending upon the specific characteristics and parameters of the equipment required;

(b) the hopper 33 instead of being being mounted upon the pivot mounting 50 at the lower end is instead mounted upon a pivot mounting at the upper end of the inclined lower wall 34 of the hopper so the upper end of the hopper is fixed against vertical movement but is allowed to pivot. The lower end of the hopper is free from support so that it can be raised and lowered by operation of the eccentric drive system. In this arrangement there is no necessity for a spring pulling the hopper downwardly since the weight of the hopper tends to turn the hopper around the upper pivot to achieve its lowermost position resting upon the eccentric drive system;

(c) in place of the striker and cam arrangement of the embodiment shown, there is provided an eccentric shaft drive in which the shaft is attached to an underside of the hopper and is carried in bearings at the ends of the shaft. The shaft is then eccentric so that each rotation of the shaft acts to lift the hopper through a controlled amount upwardly and then downwardly to cause the shaking action. The shaft is driven by a v-belt arrangement from a motor having an axis parallel to the shaft and supported upon the support bracket 68. This arrangement avoids the harsh hammering action of the cam and striker plate and the noisy operation caused thereby. The smoother action provided by the eccentric shaft generates less wear and provides a more controlled action on the hopper to ensure a more consistent feed of the material through the gate;

(d) the shaft is driven by the motor mounted on the bracket 68 which is a 12 volt motor driven by a battery power source.

Since various modifications can be made in my invention as hereinabove described, and many apparently widely different embodiments of same made within the spirit and scope of the claims without departing from such spirit and scope, it is intended that all matter contained in the accompanying specification shall be interpreted as illustrative only and not in a limiting sense.

I claim:

1. Apparatus for mixing a first particulate material with a second particulate material comprising an auger having an auger tube with a feed end and a discharge end and an auger flight mounted within the tube, means for rotatable driving the flight within the tube so as to feed material from the feed end to the discharge end, means for mounting the auger tube in an orientation inclined to the horizontal such that the feed end is arranged below the discharge end, the flight having a portion thereof exposed at the feed end of the tube for receiving the second particulate material thereon for transport of the second particulate material along the tube from the feed end to the discharge end, a first feed means mounted on the auger tube for support thereby and having a liquid tank, pipe means for feeding liquid from the tank liquid flow control means on said pipe means and injector means for supplying the liquid into the auger tube at a first position thereon for mixing with the second particulate material as it is moved along the tube, and a second feeding means mounted on the auger tube for support thereby and having a hopper for said first particulate material, gate valve means for controlling a rate of discharge of the first particulate from the hopper, and means for feeding said first particulate material from the hopper into an opening in the auger tube at a second position for mixing with the second particulate material within the auger tube, the second position being located on the auger tube downstream of the first position and being spaced from the first position by a distance sufficient to cause the liquid to mix with the second particulate material before reaching the second position and the second position being spaced from the discharge end by a distance sufficient to cause the first particulate material to mix with the second particulate material prior to reaching the discharge end.

2. The invention according to claim 1 wherein the first feeding means includes a hole formed in the outer surface of the auger tube and wherein the second second feeding means includes a second hole formed in the outer surface of the auger tube.

3. The invention according to claim 1 wherein the first feeding means and the second feeding means are mounted on a support member defining a separate unit which is arranged for mounting on and removal from the auger tube.

4. The invention according to claim 1 wherein the second feeding means includes said hopper and means for metering the discharge of material from the hopper into said tube.

5. The invention according to claim 4 wherein the second feeding means includes a pipe for directing the first particulate material from the hopper to the auger tube, the pipe being mounted on the support member and being adjustable relative thereto in a direction toward and away from the auger tube.

6. Apparatus for mixing a first particulate material with a second particulate material comprising an auger having an auger tube with a feed end and a discharge end and an auger flight mounted within the tube, means for rotatably driving the flight within the tube so as to feed material from the feed end to the discharge end, means for mounting the auger tube in an orientation inclined to the horizontal such that the feed end is arranged below the discharge end, the flight having a portion thereof exposed at the feed end of the tube for receiving the second particulate material thereon for transport of the second particulate material along the tube from the feed end to the discharge end, a first feed means mounted on the auger tube for support thereby and having a liquid tank, pipe means for feeding liquid from the tank liquid flow control means on said pipe means and injector means for supplying the liquid into the auger tube at a first position thereon for mixing with the second particulate material as it is moved along the tube, and a second feeding means mounted on the auger tube for support thereby and having a hopper for said first particulate material, gate valve means for controlling a rate of discharge of the first particulate from the hopper, and means for feeding said first particulate material from the hopper into an opening in the auger tube at a second position for mixing with the second particulate material within the auger tube, the second position being located on the auger tube downstream of the first position and being spaced from the first position by a distance sufficient to cause the liquid to mix with the second particulate material before reaching the second position and the second position being spaced from the discharge end by a distance sufficient to cause the first particulate material to mix with the second particulate material prior to reaching the discharge end, wherein the first feeding means and the second feeding means are mounted on a support member defining a separate unit which is arranged for mounting on and removal from the auger tube, and wherein the support member comprises an angle iron extending longitudinally of the auger tube and mounted thereon with a longitudinal apex of the angle iron lying parallel to the auger tube and facing upwardly and outwardly from the auger tube.

7. The invention according to claim 6 wherein the first feeding means includes a support bracket extending upwardly from the angle iron and wherein the second feeding means includes a pair of support brackets extending upwardly from the angle iron for supporting the hopper means above the angle iron.

8. The invention according to claim 6 wherein the hopper includes a downwardly inclined bottom surface, an opening adjacent at the lowermost edge of the bottom surface through which the material is discharged from the hopper, gate means for varying the size of the opening, and means for vibrating the hopper to cause the material to escape from the hopper through the opening.

9. The invention according to claim 8 wherein the vibrating means comprises a rotatable member having an eccentric portion thereon and motor means for driving the rotatable member such that the rotation thereof causes vibration or movement of the hopper.

10. The invention according to claim 9 wherein the motor is a 12 volt motor.

11. The invention according to claim 9 wherein the rotating means is mounted separate from the hopper and includes a cam thereon rotatable therewith and wherein the hopper includes a striker plate which is repeatedly impacted by the cam to cause vibrating action of the hopper.

12. The invention according to claim 9 wherein the hopper carries a first pipe portion attached thereto and wherein there is provided a second pipe portion attached to said support member with the second pipe portion being adjustable longitudinally relative to the first pipe portion.

13. The invention according to claim 9 wherein the hopper is mounted on hinge means allowing rotational movement of the hopper about an axis transverse to the auger adjacent the discharge opening and wherein the hopper is mounted on resilient support means spaced from said hinge means allowing vertical movement of the part of the hopper spaced from said hinge means.

14. Apparatus for mixing a first particulate material with a second particulate material comprising an auger having an auger tube with a feed end and a discharge end and an auger flight for rotation within the tube so as to feed material from the feed end to the discharge end, feeding means having a hopper for said first particulate material, and means for feeding said first particulate material from the hopper into the auger tube at a position thereon for mixing with the second particulate material within the auger tube, wherein the hopper includes a downwardly inclined bottom surface, an opening adjacent the lowermost edge of the bottom surface through which the material is discharged from the hopper, gate means for varying the size of the opening, and means for vibrating the hopper to cause the material to escape from the hopper through the opening wherein there is provided a support member for releasably mounting said feeding means on the auger tube and wherein the feeding means includes a pipe for directing the first particulate material from the hopper to the auger tube, the pipe being mounted on the support member and being adjustable relative thereto in a direction toward and away from the auger tube.

15. The invention according to claim 14 wherein the support member comprises an angle iron extending longitudinally of the auger tube and mounted thereon with a longitudinal apex of the angle iron lying parallel to the auger tube and facing upwardly and outwardly from the auger tube.

16. The invention according to claim 14 wherein the vibrating means comprises a rotatable member having an eccentric portion thereon and motor means for driving the rotatable member such that the rotation thereof causes vibration or movement of the hopper.

* * * * *